US011459160B2

(12) United States Patent
Hu et al.

(10) Patent No.: US 11,459,160 B2
(45) Date of Patent: Oct. 4, 2022

(54) PACKAGING BOX AND CONTAINER

(71) Applicant: HKC CORPORATION LIMITED, Shenzhen (CN)

(72) Inventors: Xiaogang Hu, Shenzhen (CN); Haijiang Yuan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/366,052

(22) Filed: Jul. 2, 2021

(65) Prior Publication Data

US 2022/0081181 A1 Mar. 17, 2022

(30) Foreign Application Priority Data

Sep. 14, 2020 (CN) ..... 202010960015.8

(51) Int. Cl.

| | |
|---|---|
| ***B65D 81/26*** | (2006.01) |
| ***B65D 25/10*** | (2006.01) |
| ***B65D 85/48*** | (2006.01) |
| ***B65D 85/62*** | (2006.01) |

(52) U.S. Cl.

CPC ..... *B65D 81/266* (2013.01); *B65D 25/10* (2013.01); *B65D 85/48* (2013.01); *B65D 85/62* (2013.01)

(58) Field of Classification Search

CPC ..... B65D 21/02; B65D 25/10; B65D 51/30; B65D 81/113; B65D 81/26; B65D 81/266; B65D 85/48; B65D 85/62

USPC ..... 206/204, 449–455

See application file for complete search history.

(56) References Cited

U.S. PATENT DOCUMENTS

| | | | | |
|---|---|---|---|---|
| 8,168,272 | B2 * | 5/2012 | Morikawa | H01L 21/67393 206/455 |
| 10,392,176 | B1 * | 8/2019 | Hu | B65D 85/48 |
| 10,934,074 | B2 * | 3/2021 | Hu | B65D 81/113 |
| 11,084,636 | B2 * | 8/2021 | Wu | B65D 85/48 |
| 2020/0331673 | A1 * | 10/2020 | Wu | B65D 81/054 |

FOREIGN PATENT DOCUMENTS

| | | | | |
|---|---|---|---|---|
| CN | 104495079 | A | 4/2015 | |
| CN | 206307496 | U * | 7/2017 | B65D 81/26 |
| CN | 206750423 | U * | 12/2017 | B65D 25/10 |
| CN | 109649852 | A * | 4/2019 | B65D 81/266 |
| CN | 109987338 | A | 7/2019 | |
| CN | 209701208 | U * | 11/2019 | B65D 25/10 |
| WO | WO-2016070421 | A * | 5/2016 | B65D 51/30 |
| WO | WO-2020087629 | A1 * | 5/2020 | B65D 81/26 |

* cited by examiner

*Primary Examiner* — Bryon P Gehman

(57) ABSTRACT

The present application discloses a packaging box and a container, the packaging box includes a box body and a desiccant, the box body includes a bottom plate and a side wall, where the bottom plate and the side wall form a cavity for holding a product, a desiccant groove is provided in the side wall, the desiccant groove includes an opening in communication with the cavity, and an anti-gipping structure is disposed at the opening.

18 Claims, 3 Drawing Sheets

PACKAGING BOX AND CONTAINER

The present application claims priority to the Chinese Patent Application No. CN202010960015.8, filed Sep. 14, 2020, which is hereby incorporated by reference herein as if set forth in its entirety.

TECHNICAL FIELD

The present application relates to the technical field of packaging, particularly to a packaging box and a container.

BACKGROUND

The statements herein merely provide background information related to the present application and do not necessarily constitute the conventional art.

At present, packaging boxes are generally made of mixtures of expanded polystyrene and polyethylene, or expanded polypropylene or polystyrene. A packaging box usually consists of a box cover and a box body for shipping products such as display panels. The packaging boxes made of such expanded materials are used for protecting the display panels from damages. Meanwhile, in order to ensure the safety of display panels in the box bodies, desiccants will be placed in the box bodies to ensure that moisture condensation resulting from water transportation or day-night temperature difference will not appear on the surfaces of glass panels, or protect circuits of the panels, so that the desiccants in the box bodies is particularly important.

However, in the actual operation in factories, desiccants placed in box bodies tend to trip during handling, which leads to the breakage of liquid crystal panels directly placed in the box bodies. Therefore, how to avoid the problems of damage to products in the box bodies and breakage of display panels due to tripping of the desiccants in the box bodies during handling of the packaging boxes has become one of the focuses of research in packaging boxes.

SUMMARY

The purpose of the present application aims to provide a packaging box and a container.

The present application discloses a packaging box, including: a box body and a desiccant. The box body includes a bottom plate and a side wall, where the bottom plate and the side wall form a cavity for holding a product, and a desiccant groove is provided in the side wall; the desiccant is placed in the desiccant groove to absorb moisture in the box body; the desiccant groove includes an opening in communication with the cavity, and an anti-tripping structure is disposed at the opening to prevent the desiccant from tripping from the desiccant groove.

The present application further discloses a packaging box, including a box body and a desiccant, where the box body includes a bottom plate and a side wall, the bottom plate and the side wall form a cavity for holding a product, and a desiccant groove is provided in the side wall; the desiccant is placed in the desiccant groove to absorb moisture in the box body; the desiccant groove includes a first groove wall, a second groove wall, a third groove wall, a fourth groove wall, a bottom wall and an opening, where the first groove wall, the second groove wall, the third groove wall and the fourth groove wall connected end to end are vertically connected to the bottom wall, and the opening is disposed opposite to the bottom wall; the first groove wall and the third groove wall are provided in parallel, and the second groove wall and the fourth groove wall are provided in parallel; the first groove wall and the third groove wall are perpendicular to the second groove wall and the fourth groove wall; a notch in communication with the opening is provided on the second groove wall; the anti-tripping structure includes a flap, a vertical plate, a first side plate and a second side plate; the first side plate is disposed opposite to the second side plate; the first side plate is parallel to the second side plate; one end of the vertical plate is connected with the first side plate, and the other end is connected with the second side plate; the flap is parallel to the bottom wall, the vertical plate is parallel to the second groove wall, the first side plate is parallel to the first groove wall, and the second side plate is parallel to the third groove wall; a hollow area is disposed at the vertical plate corresponding to the notch, and the vertical plate corresponding to the upper portion of the hollow area is provided with a barrier strip, the flap with a width less than the length of the opening is fixed to the middle of the barrier strip, is connected with the fourth groove wall, and spans over the opening; a clamping plate is correspondingly provided on the fourth groove wall, where the clamping plate includes a first sub-clamping plate, a second sub-clamping plate and a third sub-clamping plate, one end of the second sub-clamping plate is connected with the first sub-clamping plate, and the other end is connected with the third sub-clamping plate; the first sub-clamping plate and the third sub-clamping plate are connected to the fourth groove wall; the first sub-clamping plate is parallel to the first groove wall, forming a first gap with the first groove wall; the second sub-clamping plate is parallel to the second groove wall, forming the second gap with the second groove wall; the third sub-clamping plate is parallel to the third groove wall, forming the third gap with the third groove wall; the first side plate is correspondingly disposed in the first gap; the second side plate is correspondingly disposed in the second gap; the vertical plate is correspondingly disposed in the third gap; the width of the first side plate and the second side plate is equal to that of the first groove wall and the third groove wall; the width of the vertical plate is equal to that of the second groove wall; the upper surfaces of the first side plate and the second side plate are flush with the upper surfaces of the first groove wall and the third groove wall; the upper surface of the flap is flush with the upper surfaces of the first side plate, the second side plate and the vertical plate; the flap, the vertical plate, the first side plate and the second side plate have a thickness of 2 mm to 10 mm; the anti-tripping structure is made of polycarbonate.

The present application further discloses a container, including the packaging box and a product packaged in the packaging box.

The anti-tripping structure is disposed at the opening of the desiccant groove in the present application to avoid the desiccant placed in the desiccant groove from tripping from the opening of the desiccant groove into the cavity of the box body, interfering with the subsequent work of packaging the product; for example, when the packaging box is adopted to package display panels, the specific steps include placing the desiccant in the desiccant groove, and then conveying the packaging box to the next machine to sequentially stack the display panels in the cavity of the packaging box; the anti-tripping structure of the present application can avoid the desiccant from falling into the cavity from the desiccant groove during transportation, interfering with the work of placing the display panels, and can also avoid problems such as breakage of display panels resulting from directly placing the display panels in the cavity due to failure to find the desiccant in the cavity.

BRIEF DESCRIPTION OF DRAWINGS

The accompanying drawings, which are included to provide a further understanding of embodiments of the present application and constitute a part of the specification, illustrate embodiments of the application and, together with the text description, explain the principles of the application. Obviously, the drawings in the following description are merely some embodiments of the present application, and those skilled in the art can obtain other drawings according to the drawings without any inventive labor. In the drawings.

DETAILED DESCRIPTION OF EMBODIMENTS

It should be understood that the terminology, specific structural and functional details disclosed are merely exemplary for the purpose of describing specific embodiments. However, the present application may be embodied in many alternative forms and should not be construed as being limited to the embodiments set forth herein.

In the description of the present application, the terms "first" and "second" are only for the purpose of description and cannot be construed to indicate relative importance or imply an indication of the number of technical features indicated. Therefore, unless otherwise stated, a feature defined as "first" and "second" may explicitly or implicitly include one or more of the features; "multiple" means two or more. The term "include" and any variations thereof are intended to be inclusive in a non-closed manner, that is, the presence or addition of one or more other features, integers, steps, operations, units, components and/or combinations thereof may be possible.

In addition, the terms "center", "horizontally", "up", "down", "left", "right", "vertical", "horizontal", "top", "bottom", "inner", "outer" and the like for indicating an orientation or positional relationship are based on the description of the orientation or relative positional relationship shown in the accompanying drawings, and are only simplified description facilitating description of the application, and are not intended to indicate that the device or element referred to must have a particular orientation, be configured and operated in a particular orientation, and therefore cannot be construed as limiting the present application.

In addition, unless expressly specified and defined otherwise, the terms "mount", "attach" and "connect" are to be understood broadly. For example, it can be a fixed connection, a detachable connection, or an integral connection; it can be either a mechanical connection or an electrical connection; it can be a direct connection or an indirect connection through an intermediate medium, or an internal connection between two elements. For those skilled in the art, the specific meaning of the above terms in the present application can be understood according to the specific circumstances.

The present application will now be described in details by reference to the accompanying drawings and optional embodiments.

Figure 1:
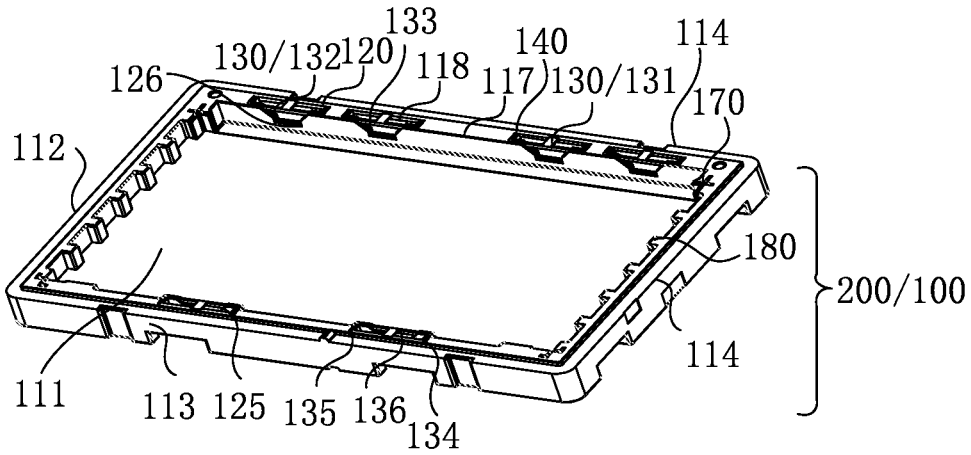
FIG. 1 is a schematic diagram of a packaging box according to an embodiment of the present application.
Figure 2:
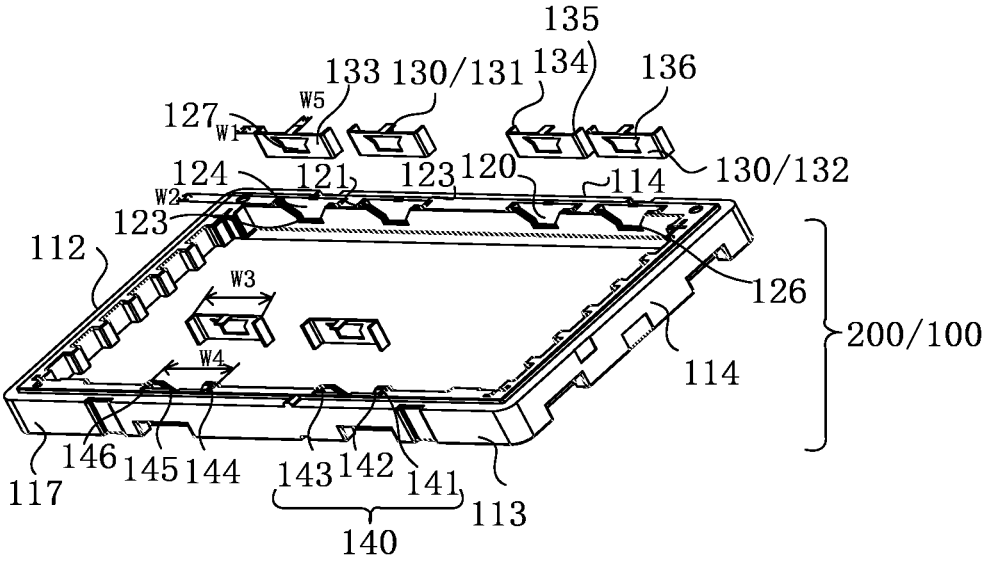
FIG. 2 is a schematic diagram of a packaging box according to an embodiment of the present application.

As shown in FIGS. 1 to 2, an embodiment of the present application discloses a container 200, including a packaging box 100 and a product. The packaging box 100 includes: a box body 110 and a desiccant 118, where the box body 110 includes a bottom plate 111 and a side wall 117, the bottom plate 111 and the side wall 117 form a cavity 116 for holding a product, and a desiccant groove 120 is provided in the side wall 117; the desiccant 118 is placed in the desiccant groove 120 to absorb moisture in the box body 110;

the desiccant groove 120 includes an opening 125 in communication with the cavity 116, and an anti-tripping structure 130 is disposed at the opening 125 to prevent the desiccant 118 from tripping from the desiccant groove 120.

In this solution, the anti-tripping structure 130 is disposed at the opening 125 of the desiccant groove 120 in the present application to avoid the desiccant 118 placed in the desiccant groove 120 from tripping from the opening 125 of the desiccant groove 120 into the cavity 116 of the box body 110, interfering with the subsequent work of packaging the product; for example, when the packaging box 100 is adopted to package display panels, the specific steps include placing the desiccant 118 in the desiccant groove 120, and then conveying the packaging box 100 to the next machine to sequentially stack the display panels in the cavity 116 of the packaging box 100; the anti-tripping structure 130 of the present application can avoid the desiccant 118 from falling into the cavity 116 from the desiccant groove 120 during transportation, interfering with the work of placing the display panels, and can also avoid problems such as breakage of display panels resulting from directly placing the display panels in the cavity due to failure to find the desiccant 118 in the cavity 116.

It should be noted that the product in the packaging box of the present application takes display panels as an example, but the product is not limited to the display panels. For example, touch panels is also applicable to the packaging box of the present application. Specifically, the box body 110 includes a first side wall 112, a second side wall 113, a third side wall 114, a fourth side wall 115 and a bottom plate 111, where the first side wall 112, the second side wall 113, the third side wall 114 and the fourth side wall 115 connected end to end are vertically connected to the bottom plate 111, and the first side wall 112 and the third side wall 114 are arranged in parallel; the second side wall 113 and the fourth side wall 115 are arranged in parallel; the length of the first side wall 112 and the third side wall 114 is less than that of the second side wall 113 and the fourth side wall 115;

the desiccant groove 120 includes a plurality of desiccant grooves 120 which are disposed on the second side wall 113 and the fourth side wall 115; the box body 110 includes a plurality of reinforcing ribs 180 and stops 170 disposed on the first side wall 112 and the third side wall 114, the reinforcing ribs 180 are disposed at an interval facing the cavity 116, the stops 170 are disposed at positions where the first side wall 112, the second side wall 113, the third side wall 114 and the fourth side wall 115 are connected end to end, and the number of the stops 170 is four. In this solution, the reinforcing ribs 180 are disposed on the side walls to reduce or prevent displacement of the display panel, limit the display panel and reinforce the packaging box 100, and the stops 170 at corners can avoid the display panel bumping against the corners, avoiding breakage of the display panel.

In one or more embodiments, the anti-tripping structure 130 specifically includes a main body 132 and a flap 131, where the flap 131 extends outward from the main body 132; the flap 131 spans over the opening 125 when the anti-tripping structure 130 is embedded into the desiccant groove 120. In this solution, the flap 131 spans over the opening 125 where the desiccant 118 tends to trip, so that when the desiccant 118 trips due to vibration during handling in an automatic line, the flap 131 gives a resistance to the desiccant 118 to avoid the desiccant 118 from falling out of the desiccant groove 120, thereby achieving the purpose of preventing the desiccant from tripping.

Specifically, the desiccant groove 120 includes a groove wall, a clamping plate is disposed in the desiccant groove 120, a gap is formed between the groove wall and the clamping plate 140, and the main body 132 is fixedly embedded into the gap. In this solution, a gap is formed between the clamping plate and the groove wall, and the anti-tripping structure 130 can be fitted more closely with the groove wall, so that the anti-tripping structure 130 can be stably fixed, which can avoid the anti-tripping structure 130 and the desiccant 118 from falling into the cavity 116 due to looseness of the anti-tripping structure 130. The way of fixing by the clamping plate 140 replaces tedious ways of fixing.

Further, the main body 132 includes a vertical plate 133, a first side plate 134 and a second side plate 135, where the first side plate 134 and the second side plate 135 are vertically connected to both ends of the vertical plate 133, and the main body 132, the first side plate 134 and the second side plate 135 are fixedly embedded into the gap; the flap 131 is fixed to the vertical plate 133. In this solution, the vertical plate 133, the first side plate 134 and the second side plate 135 perpendicular to each other are fixedly embedded into the gap, so that the anti-tripping structure 130 is not easy to loosen due to an acting force in a certain direction, and can also reinforce the groove wall of the desiccant groove 120, avoiding the problem of damage to the groove wall due to the thin groove wall of the desiccant groove 120; specifically, the desiccant groove 120 of the present application is rectangular, and the anti-tripping structure 130 is embedded into the desiccant groove 120 without a gap. If the desiccant groove 120 is of other shapes, the shape of the anti-tripping structure 130 can be changed accordingly to be embedded into the desiccant groove 120.

Specifically, the vertical plate 133 is disposed on a side of the desiccant groove 120 close to the cavity 116, the first side plate 134 and the second side plate 135 extend from the vertical plate 133 in a direction away from the cavity 116, a notch 126 is disposed on a side of the desiccant groove 120 corresponding, to the cavity 116, and a hollow area 127 is disposed at the vertical plate 133 corresponding to the notch 126. In this solution, the hollow area 127 can be trapezoidal or rectangular or Y-shaped, the shape of the notch 126 is matched with that of the hollow area 127 to ensure that the drying range of the desiccant 118 is not affected by the blocking of the vertical plate 133, so that the moisture absorption in the packaging box 100 is normal, the size of the desiccant 118 is larger than that of the notch 126 and the hollow area 127, thus avoiding the problem of breakage of the display panel due to uneven inner surface of the cavity 116 as the desiccant 118 trips from the notch 126 and the hollow area 127 into the cavity 116 of the box body 110.

Figure 3:
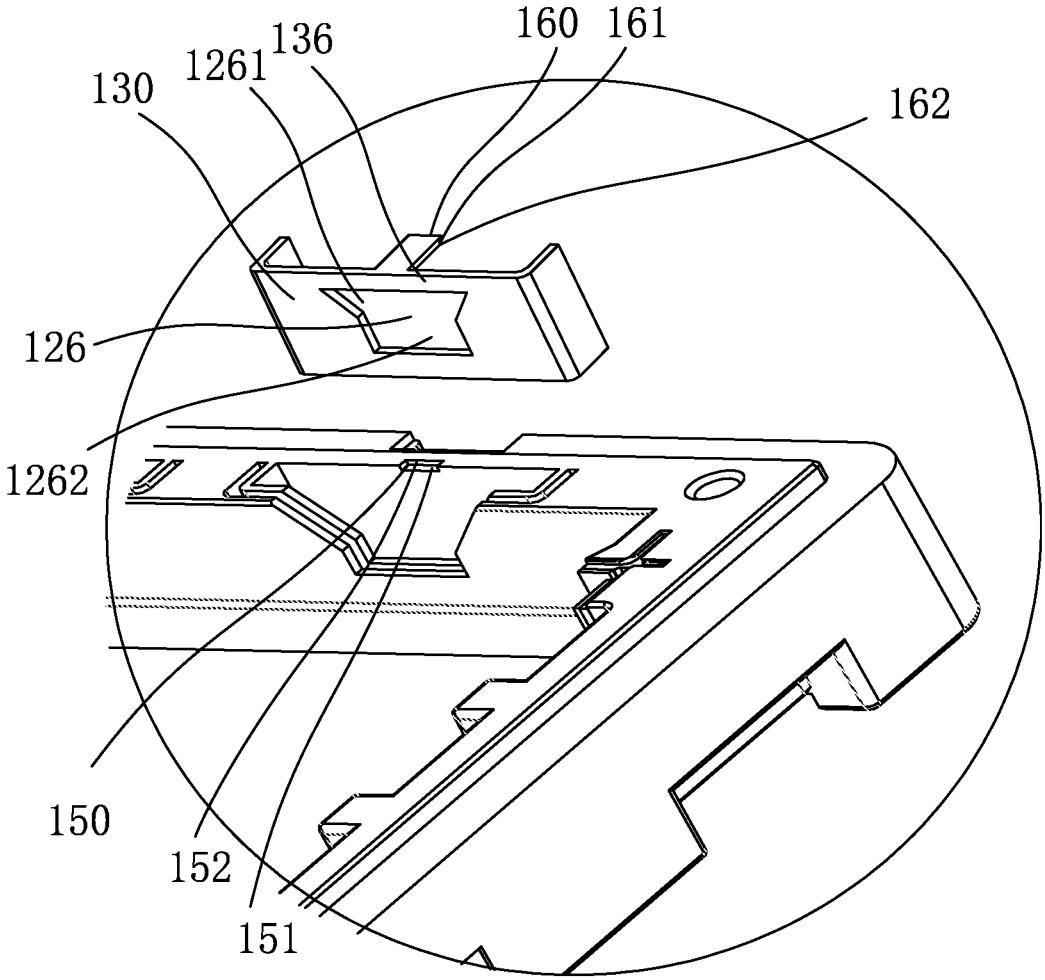
FIG. 3 is a local vie of a packaging box according to another embodiment of the present application.

With reference to FIG. 3, the notch 126 includes a first notch portion 1261 and a second notch portion 1261 in communication with each other, where the first notch portion 1261 is located above the second notch portion 1262; the width of the first notch portion 1261 is larger than that of the second notch portion 1262, and the width of the second notch portion 1262 is less than that of the desiccant. With the end where the first notch portion 1261 is in communication with the second notch portion 1262 as a starting position, the farther the first notch portion 1261 is from the starting position, the wider the width is; the width of the second notch portion 1262 at any position is the same. The second notch portion 1262 is located at the bottom and has a uniform width less than that of the desiccant to prevent the desiccant from sliding out of the notch; the opening width of the first notch portion 1261 is gradually increased, so that the contact area between the desiccant and the cavity 116 can be increased, and the moisture adsorption effect of the desiccant can be improved.

In one or more embodiments, the vertical plate 133 is provided with a barrier strip 136 corresponding to the upper portion of the hollow area 127, and the flap 131 with a length (L1) less than or equal to the width of the opening 125 and with a width (W5) less than or equal to the length of the opening 125 is horizontally disposed and vertically fixed to the middle of the barrier strip 136. In this solution, the flap 131 is horizontally disposed, spans over the opening 125 and is disposed in the middle of the vertical plate 133, and both the flap 131 and the barrier strip have the effect of blocking the desiccant 118 from falling out of the desiccant groove. In addition, when the desiccant 118 needs to be replaced, it is convenient to access to the flap 131 and the barrier strip to take the anti-tripping structure 130 out conveniently. The flap 131 supports the opening 125 of the desiccant groove 120 horizontally to enhance the support strength of the opening 125, which avoids breakage of the opening 125 of the desiccant groove 120 due to reduced support at the opening 125, and breakage of the box body 110 of the packaging box 100. A plurality of flaps 131 can be uniformly disposed on the vertical plate 133 at an interval, so that the strength under stress at the opening 125 of the desiccant groove 120 is higher, and the strength of the entire packaging box 100 is enhanced; specifically, the flap 131 has the same size as the opening 125, the notch 126 is only disposed on a side of the desiccant groove 120 close to the cavity 116, and the hollow area 127 is disposed on the side of the vertical plate 133 of the anti-tripping structure 130.

Another embodiment of the present application discloses a packaging box 100, including: a box body 110 and a desiccant 118, where the box body 110 includes a bottom plate 111 and a side wall 117, the bottom plate 111 and the side wall 117 form a cavity 116 for holding a product, and a desiccant groove 120 is provided in the side wall 117; the desiccant 118 is placed in the desiccant groove 120 to absorb moisture in the box body 110; the desiccant groove 120 includes a first groove wall 121, a second groove wall 122, a third groove wall 123, a third groove wall 124, a bottom wall and an opening 125, where the first groove wall 121, the second groove wall 122, the third groove wall 123 and the third groove wall 124 connected end to end are vertically connected to the bottom wall, and the opening 125 is disposed opposite to the bottom wall;

the first groove wall 121 and the third groove wall 123 are arranged in parallel, and the second groove wall 122 and the third groove wall 124 are arranged in parallel; the first groove wall 121 and the third groove wall 123 are perpendicular to the second groove wall 122 and the third groove wall 124; a notch 126 in communication with the opening 125 is formed in the second groove wall 122;

the anti-tripping structure 130 includes a flap 131, a vertical plate 133, a first side plate 134 and a second side plate 135; the first side plate 134 is disposed opposite to the second side plate 135; the first side plate 134 is parallel to the second side plate 135; one end of the vertical plate 133 is connected with the first side plate 134, and the other end is connected with the second side plate 135;

the flap 131 is parallel to the bottom wall, the vertical plate 133 is parallel to the second groove wall 122, the first side plate 134 is in contact with the first groove wall 121, and the second side plate 135 is in contact with the third groove wall 123; a hollow area 127 is disposed at the vertical plate 133 corresponding to the notch 126, and the vertical plate 133 corresponding to the upper portion of the hollow area 127 is provided with a barrier strip 136, the flap 131 with a width less than the length of the opening 125 is fixed to the middle of the barrier strip 136 and connected with the third groove wall 124, and spans over the opening 125;

a clamping plate 140 is correspondingly arranged on the third groove wall 124, where the clamping plate 140 includes a first sub-clamping plate 141, a second sub-clamping plate 142 and a third sub-clamping plate 143, one end of the second sub-clamping plate 142 is connected with the first sub-clamping plate 141, and the other end is connected with the third sub-clamping plate 143; the first sub-clamping plate 141 and the third sub-clamping plate 143 are connected to the third groove wall 124; the first sub-clamping plate 141 is parallel to the first groove wall 121, forming a first gap 144 with the first groove wall 121; the second sub-clamping plate 142 is parallel to the second groove wall 122, forming the second gap 145 with the second groove wall 122; the third sub-clamping plate 143 is parallel to the third groove wall 123, forming the third gap 146 with the third groove wall 123; the first side plate 134 is correspondingly disposed in the first gap 144; the second side plate 135 is correspondingly disposed in the second gap 145; the vertical plate 133 is correspondingly disposed in the third gap 146;

the width of the first side plate 134 and the second side plate 135 is equal to that of the first groove wall 121 and the third groove wall 123: the width of the vertical plate 133 is equal to that of the second groove wall 122; the upper surfaces of the first side plate 134 and the second side plate 135 are flush with the upper surfaces of the first groove wall 121 and the third groove wall 123; the upper surface of the flap 131 is flush with the upper surfaces of the first side plate 134, the second side plate 135 and the vertical plate 133.

In this solution, the width W1 of the first side plate 134 and the second side plate 135 is equal to the width W2 of the first groove wall 121 and the third groove wall 123; the width W3 of the vertical plate 133 is equal to the width W4 of the second groove wall 122; the anti-tripping structure 130 is clamped and fixed through the gap between the groove wall of the desiccant groove 120 and the clamping plate. The clamping plate includes three sub-clamping plates, the three sub-clamping plates are arranged in an enclosed structure to enclose the desiccant 118 in the anti-tripping structure 130 and stably fix the whole anti-tripping structure 130 on the opening 125 and the notch 126, which is equivalent to increasing the thickness of a layer of groove wall, thus enhancing the strength of the whole desiccant groove 120. Since the opening 125 is the most vulnerable position for the desiccant 118 to trip, the flap 131 arranged corresponding to the opening 125 and the barrier strip 136 on the vertical plate 133 arranged corresponding to the notch 126 can directly prevent the desiccant 118 from tripping from the opening 125 and the notch 126, thus effectively solving the problem of tripping of the desiccant 118 during handling, and preventing the desiccant from falling into the box body, so that the anti-tripping structure 130 does not influence the action range of the desiccant 118, and normal moisture absorption is ensured. The width of the first side plate 134 and the second side plate 135 is equal to that of the first groove wall 121 and the third groove wall 123; the width of the vertical plate 133 is equal to that of the second groove wall 122. During handling, the wall of the desiccant groove 120 corresponding to the box body 110 is thin and bears less pressure, when a hand holds here, the anti-tripping structure 130 serves as a support in the desiccant groove 120, which increases the pressure inside the desiccant groove 120, thus increasing the bearing capacity of the desiccant groove 120, playing a role in strengthening the desiccant groove 120, and avoiding breakage of the box body when the position of the box body corresponding to the desiccant groove 120 is held when moving the box body. There may be two clamping plates to fix two corresponding side plates respectively, and the flap can also be fixed at the opening 125. In this solution, the cost can be reduced on the basis of ensuring the fixing of the anti-tripping structure 130.

As shown in FIG. 3, a slot 150 is disposed at the desiccant groove 120 corresponding to the flap 131 at the opening 125, and an end of the flap 131 away from the main body 132 is engaged with the slot 150; further, the slot 150 includes a first clamping wall 161151 and a second clamping wall 162152, the first clamping wall 161151 and the second clamping wall 162152 are vertically arranged. In this solution, the flap 131 is fixed to both the main body 132 and the slot 150, and the fixing effect on both sides is good, which can prevent the flap 131 from loosening and causing damage. When the groove wall is under an external pressure, ends of the flap 131 can abut against the slot 150, there is an accepted stress bearing point, and the slot 150 limits the flap 131 to displace horizontally at the opening 125, so that the flap 131 will not slip, which avoids the flap from decreasing the strength of the desiccant groove 120, and avoids the possibility of reduction in strength of the desiccant groove 120 due to extrusion.

An end of the flap 131 is provided with a clamping platform 160 matched with the slot 150. The clamping platform 160 includes a first platform wall and a second platform wall, the first platform wall and the second platform wall are vertically arranged, where the first platform wall is in contact with the first clamping wall 161151; the second platform wall is in contact with the second clamping wall 162152. In this solution, the limiting of the flap 131 and the groove wall is more effective through the matching of the clamping platform 160 and the clamping groove 150.

Specifically, the anti-tripping structure may be made of a terpolymer of polycarbonate or acrylonitrile, butadiene and styrene, and the flap 131, the vertical plate 133, the first side plate 134 and the second side plate 135 have a thicknesses of 2 mm to 10 mm.

As the anti-tripping structure 130 is embedded into the desiccant groove 120, the desiccant groove 120 is supported on the premise of preventing the desiccant 118 from tripping and not influencing the drying range of the desiccant 118, so that the anti-tripping structure 130 plays a role in reinforcing the desiccant groove 120, and the packaging box 100 is reinforced as a whole. The anti-tripping structure plays an important role of reinforcement whether in handling or in tests. Since the material strength of the anti-tripping structure is greater than that of the packaging box 100, the anti-tripping structure is wear-resistant and durable, has a long service life and is not easy to deform, the strength of the desiccant groove 120 where the desiccant 118 is located has a promoting effect, so that the overall strength of the packaging box 100 is increased, and the safety of the display panel during handling and transportation is improved. For example, in a customized special test, the slope test requires that a test object is elevated by 10 degree to hit against a slope at a speed of 1.8 m/s. In addition to ensuring the safety of the liquid crystal panel in the box body, there should be no obvious damage to the packaging box 100.

Figure 4:
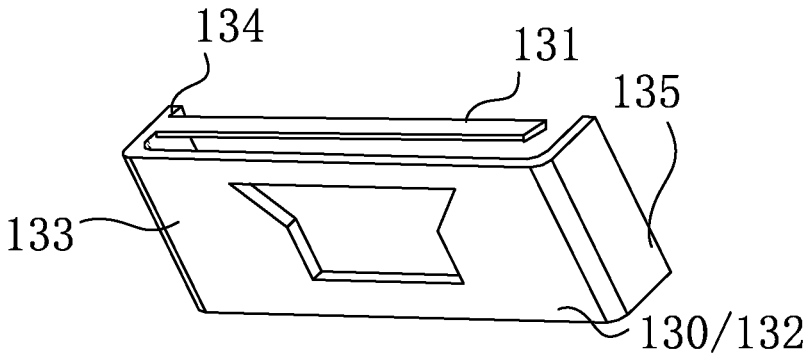
FIG. 4 is a schematic diagram of an anti-tripping structure according to an embodiment of the present application.

As shown in FIG. 4, in one or more embodiments, different embodiments are shown: the first side plate 134 and the second side plate 135 are perpendicular to the vertical plate 133, and the flap 131 is horizontally arranged with an end thereof fixed to the first side plate 134 or the second side plate 135. In this solution, the flap spans over the opening 125 vertically, which prevents tripping of the desiccant 118 to the maximum extent, and encloses the desiccant 118 from tripping, so that the anti-tripping effect is the most obvious.

Figure 5:
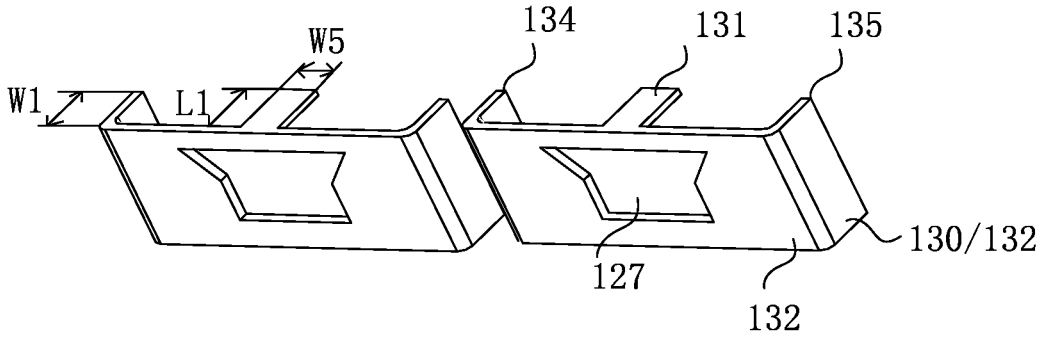
FIG. 5 is a schematic diagram of an anti-tripping structure according to another embodiment of the present application.

As shown in FIG. 5, another embodiment of the present application discloses an anti-tripping structure 130, including a flap 131, a vertical plate 133, a first side plate 134 and a second side plate 135; the first side plate 134 is disposed opposite to the second side plate 135; the first side plate 134 is parallel to the second side plate 135; one end of the vertical plate 133 is connected with the first side plate 134, and the other end is connected with the second side plate 135; the upper surface of the flap 131 is flush with the upper surfaces of the first side plate 134, the second side plate 135 and the vertical plate 133; the length of the flap 131 is equal to the width of the first side plate 134 and the second side plate 135; the vertical plate 133, the first side plate 134 and the second side plate 135 have the same height, and a hollow area is disposed on the vertical plate 133; the vertical plate 133 corresponding to the upper portion of the hollow area 127 is provided with a barrier strip 136, and the flap 131 is fixed to the middle of the barrier strip 136; the anti-tripping structure 130 is made of polycarbonate; the flap 131, the vertical plate 133, the first side plate 134 and the second side plate 135 have a thickness of 2 mm to 10 mm. In this solution, the length of the flap 131 is L1, and the width of the flap 131 is W2; the length (L1) of the flap 131 is larger than 0, the width (W5) of the flap 131 is larger than 0, the anti-tripping structure 130 forms a semi-enclosed support frame which is embedded into the desiccant groove 120 to enclose the product in the desiccant groove 120, thus preventing the product in the desiccant groove 120 from tripping while reinforcing the strength of the desiccant groove 120, so that the structure is simple, durable and cost-effective.

The above content is a further detailed description of the present application in conjunction with specific, optional embodiments, and it is not to be construed that specific embodiments of the present application are limited to these descriptions. For those of ordinary skill in the art to which this application belongs, a number of simple derivations or substitutions may be made without departing from the spirit of this application, all of which shall be deemed to fall within the scope of this application.

What is claimed is:

1. A packaging box, comprising:

a box body, comprising a bottom plate and a side wall, wherein the bottom plate and the side wall form a cavity configured for holding a product, and a desiccant groove is defined in the side wall; and a desiccant, placed in the desiccant groove to absorb moisture in the box body;

wherein the desiccant groove comprises an opening in communication with the cavity, and an anti-tripping structure is disposed at the opening to prevent the desiccant from jumping out from the desiccant groove;

wherein the anti-tripping structure comprises a main body and a flap extending outward from the main body; the flap spans the opening when the anti-tripping structure is embedded into the desiccant groove;

wherein the opening of the desiccant groove comprises a top opening portion coplanar with a top surface of the side wall, the top surface of the side wall being parallel with the bottom plate of the box body, and wherein the flap is an elongated plate that is fixedly connected to the main body, that is arranged coplanar with the top opening portion of the opening of the desiccant groove, and that spans the top opening portion to prevent the desiccant from jumping out of the desiccant groove.

2. The packaging box according to claim 1, wherein the desiccant groove comprises a groove wall, wherein a clamping plate is disposed in the desiccant groove, a gap is formed between the groove wall and the clamping plate, and wherein the main body is fixedly embedded into the gap.

3. The packaging box according to claim 2, wherein the main body comprises a vertical plate, a first side plate, and a second side plate, wherein the first side plate and the second side plate are respectively vertically connected to two ends of the vertical plate and are disposed on a same side of the vertical plate, wherein the main body, the first side plate, and the second side plate are fixedly embedded into the gap, and wherein the flap is fixed to at least one selected from the group consisting of the first side plate and the second side plate.

4. The packaging box according to claim 2, wherein the main body comprises a vertical plate, a first side plate, and a second side plate, wherein the first side plate and the second side plate are respectively vertically connected to two ends of the vertical plate and are disposed at a same side of the vertical plate, wherein the main body, the first side plate, and the second side plate are embedded into the gap, and wherein the flap is fixed to the vertical plate.

5. The packaging box according to claim 4, wherein the flap, the vertical plate, the first side plate and the second side plate each have a thickness of 2 mm to 10 mm.

6. The packaging box according to claim 4, wherein the vertical plate is disposed on a side of the desiccant groove adjacent to the cavity, wherein the first side plate and the second side plate extend from the vertical plate in a direction away from the cavity, a notch portion is defined in a side of the desiccant groove adjacent to the cavity, and a hollow area is defined in the vertical plate corresponding to the notch.

7. The packaging box according to claim 6, wherein the vertical plate comprises a barrier strip above the hollow area, and the flap with a length less than or equal to a width of the opening and with a width less than or equal to a length of the opening is horizontally disposed and vertically fixed to a middle of the barrier strip.

8. The packaging box according to claim 6, wherein the notch comprises a first notch portion and a second notch portion in communication with each other, wherein the first notch portion is located on the second notch portion; a width of the first notch portion is larger than a width of the second notch portion, and the width of the second notch portion is less than a width of the desiccant.

9. The packaging box according to claim 8, wherein with an end where the first notch portion is in communication with the second notch portion as a starting position, the farther the first notch portion is from the starting position, the wider the width of the first notch portion is; the width of the second notch portion at any position is the same.

10. The packaging box according to claim 6, wherein the hollow area defined in the vertical plate corresponding to the notch is congruent with the notch.

11. The packaging box according to claim 1, wherein a corresponding flap-receiving notch is defined in an upper inner edge of a side wall of the groove opposite the side of the groove adjacent to the cavity, and wherein an end of the flap away from the main body is engaged with the flap-receiving notch.

12. The packaging box according to claim 1, wherein the desiccant groove comprises a first groove wall, a second groove wall, a third groove wall, a fourth groove wall, a bottom wall and an opening, wherein the first groove wall, the second groove wall, the third groove wall and the fourth groove wall connected end to end are vertically connected to the bottom wall, and the top opening portion is defined opposite to the bottom wall;

the first groove wall and the third groove wall are arranged in parallel, and the second groove wall and the fourth groove wall are arranged in parallel; the first groove wall and the third groove wall are perpendicular to the second groove wall and the fourth groove wall; a notch portion in communication with the top opening portion is defined in the second groove wall.

13. The packaging box according to claim 12, wherein the anti-tripping structure comprises a flap, a vertical plate, a first side plate and a second side plate; the first side plate is disposed opposite to the second side plate; the first side plate is parallel to the second side plate; one end of the vertical plate is connected with the first side plate, and another end of the vertical plate is connected with the second side plate;

the flap is parallel to the bottom wall, the vertical plate is parallel to the second groove wall, the first side plate is parallel to the first groove wall, and the second side plate is parallel to the third groove wall; a hollow area is defined in the vertical plate corresponding to the notch, and the vertical plate comprises a barrier strip arranged above the hollow area, wherein the flap with a width less than a length of the opening is fixed to a middle of the barrier strip is connected with the fourth groove wall and spans the opening;

a clamping plate is correspondingly arranged on the fourth groove wall, wherein the clamping plate comprises a first sub-clamping plate, a second sub-clamping plate and a third sub-clamping plate, one end of the second sub-clamping plate is connected with the first sub-clamping plate, and another end of the second sub-clamping plate is connected with the third sub-clamping plate; the first sub-clamping plate and the third sub-clamping plate are connected to the fourth groove wall;

the first sub-clamping plate is parallel to the first groove wall, forming a first gap with the first groove wall;

the second sub-clamping plate is parallel to the second groove wall, forming a second gap with the second groove wall;

the third sub-clamping plate is parallel to the third groove wall, forming a third gap with the third groove wall;

the first side plate is correspondingly disposed in the first gap;

the second side plate is correspondingly disposed in the second gap;

the vertical plate is correspondingly disposed in the third gap;

a width of the first side plate and the second side plate is equal to a width of the first groove wall and the third groove wall; a width of the vertical plate is equal to a width of the second groove wall; upper surfaces of the first side plate and the second side plate are flush with upper surfaces of the first groove wall and the third groove wall; an upper surface of the flap is flush with the upper surfaces of the first side plate, the second side plate and the vertical plate.

14. The packaging box according to claim 1, wherein the anti-tripping structure is made of polycarbonate.

15. A packaging box, comprising:

a box body, comprising a bottom plate and a side wall, wherein the bottom plate and the side wall form a cavity configured for holding a product, and a desiccant groove is defined in the side wall; and a desiccant, placed in the desiccant groove to absorb moisture in the box body;

wherein the desiccant groove comprises a first groove wall, a second groove wall, a third groove wall, a fourth groove wall, a bottom wall and an opening, wherein the first groove wall, the second groove wall, the third groove wall and the fourth groove wall connected end to end are vertically connected to the bottom wall, and the opening is defined opposite to the bottom wall;

the first groove wall and the third groove wall are arranged in parallel, and the second groove wall and the fourth groove wall are arranged in parallel; the first groove wall and the third groove wall are perpendicular to the second groove wall and the fourth groove wall; a notch in communication with the opening is defined in the second groove wall;

the anti-tripping structure comprises a flap, a vertical plate, a first side plate and a second side plate; the first side plate is disposed opposite to the second side plate; the first side plate is parallel to the second side plate; one end of the vertical plate is connected with the first side plate, and another end of the vertical plate is connected with the second side plate;

the flap is parallel to the bottom wall, the vertical plate is parallel to the second groove wall, the first side plate is parallel to the first groove wall, and the second side plate is parallel to the third groove wall; a hollow area is defined in the vertical plate corresponding to the notch, and the vertical plate comprises a barrier strip above the hollow area, the flap with a width less than a length of the opening is fixed to a middle of the barrier strip, is connected with the fourth groove wall, and spans the opening;

a clamping plate is correspondingly arranged on the fourth groove wall, wherein the clamping plate comprises a first sub-clamping plate, a second sub-clamping plate and a third sub-clamping plate, one end of the second sub-clamping plate is connected with the first sub-clamping plate, and another end of the second sub-clamping plate is connected with the third sub-clamping plate; the first sub-clamping plate and the third sub-clamping plate are connected to the fourth groove wall;

the first sub-clamping plate is parallel to the first groove wall, forming a first gap with the first groove wall;

the second sub-clamping plate is parallel to the second groove wall, forming a second gap with the second groove wall;

the third sub-clamping plate is parallel to the third groove wall, forming a third gap with the third groove wall;

the first side plate is correspondingly disposed in the first gap;

the second side plate is correspondingly disposed in the second gap;

the vertical plate is correspondingly disposed in the third gap;

a width of the first side plate and the second side plate is equal to a width of the first groove wall and the third groove wall; a width of the vertical plate is equal to a width of the second groove wall; upper surfaces of the first side plate and the second side plate are flush with upper surfaces of the first groove wall and the third groove wall; an upper surface of the flap is flush with the upper surfaces of the first side plate, the second side plate and the vertical plate;

the flap, the vertical plate, the first side plate and the second side plate each have a thickness of 2 mm to 10 mm; and the anti-tripping structure is made of polycarbonate.

16. A container, comprising a packaging box and a product packaged in the packaging box; wherein the packaging box comprises:

a box body, comprising a bottom plate and a side wall, wherein the bottom plate and the side wall form a cavity configured for holding a product, and a desiccant groove is defined in the side wall; and a desiccant, placed in the desiccant groove to absorb moisture in the box body;

wherein the desiccant groove comprises an opening in communication with the cavity, and an anti-tripping structure is disposed at the opening to prevent the desiccant from jumping out from the desiccant groove;

wherein the anti-tripping structure comprises a main body and a flap extending outward from the main body; the flap spans the opening when the anti-tripping structure is embedded into the desiccant groove;

wherein the opening of the desiccant groove comprises a top opening portion coplanar with a top surface of the side wall, the top surface of the side wall being parallel with the bottom plate of the box body, and wherein the flap is an elongated plate that is fixedly connected to the main body, that is arranged coplanar with the top opening portion of the opening of the desiccant groove, and that spans the top opening portion to prevent the desiccant from jumping out of the desiccant groove.

17. The container according to claim 16, wherein the desiccant groove comprises a groove wall, wherein a clamping plate is disposed in the desiccant groove, a gap is formed between the groove wall and the clamping plate, and wherein the main body is fixedly embedded into the gap.

18. The container according to claim 17, wherein the main body comprises a vertical plate, a first side plate, and a second side plate, wherein the first side plate and the second side plate are respectively vertically connected to two ends of the vertical plate and are disposed at a same side of the vertical plate, wherein the main body, the first side plate, and the second side plate are embedded into the gap, and wherein the flap is fixed to the vertical plate.

* * * * *